United States Patent [19]

Rajala et al.

[11] Patent Number: 4,955,113

[45] Date of Patent: Sep. 11, 1990

[54] FASTENING MEANS, APPARATUS, AND METHODS

[75] Inventors: Gregory J. Rajala; Lon M. King, both of Neenah, Wis.

[73] Assignee: Kimberly-Clark Corporation, Neenah, Wis.

[21] Appl. No.: 343,961

[22] Filed: Apr. 25, 1989

Related U.S. Application Data

[62] Division of Ser. No. 118,120, Nov. 4, 1987, Pat. No. 4,861,399.

[51] Int. Cl.[5] ..... A44B 18/00

[52] U.S. Cl. ..... 24/448; 24/442; 24/306

[58] Field of Search ..... 24/442, 443, 444, 448, 24/450, 306; 2/DIG. 6

[56] References Cited

U.S. PATENT DOCUMENTS

| | | | |
|---|---|---|---|
| 3,726,752 | 4/1973 | Provost | 24/444 |
| 3,849,840 | 11/1974 | Yamada et al. | 24/450 |
| 4,290,174 | 9/1981 | Kalleberg | 24/444 |
| 4,454,183 | 6/1984 | Wollman | 24/306 |
| 4,615,084 | 10/1986 | Erb | 24/442 |
| 4,707,893 | 11/1987 | Hashizume et al. | 24/450 |
| 4,784,890 | 11/1988 | Black | 24/443 |

FOREIGN PATENT DOCUMENTS

| | | | |
|---|---|---|---|
| 0579886 | 9/1976 | Switzerland | 24/442 |

*Primary Examiner*—Victor N. Sakran
*Attorney, Agent, or Firm*—Douglas L. Miller

[57] ABSTRACT

Apparatus and methods for producing a novel fastener means of the type having a plurality of fastening means extending from bight portions 60 bonded to a backing material 48. Products fabricated with the novel fastener means. The apparatus generally comprises means for drawing an array of filaments 46, or other material, onto a forming wheel 14 having a plurality of grooves 28, and land zones 30 between the grooves, means for positioning a plurality of pins 42 against the filaments 46 and aligned with the grooves 28, means for urging the pins 42 into the grooves 28 and thereby forming loops 50 in the filaments 46, and means for placing a backing material 48 against the filaments 46 and bonding the backing material to the filaments at spaced locations. Pins 42 are trapped in spaces 53 between the filaments 46 and the backing material 48. The apparatus further includes means for releasing the pins from the spaces. A novel nip comprises the rotatable forming wheel 14, a backing means 16, and the pins 42 which are mounted for passing between the forming wheel and the backing means in alignment with the grooves 28. The nip also comprises means for advancing the pins through the nip, such that the pins are urged into the grooves during the advance through the nip. Also disclosed are methods for producing fastening elements, methods for processing filaments, methods for producing fastening components, methods for forming loops in material, including filaments, and methods for bonding loops of filaments to a backing material at spaced locations on the backing material; all using the apparatus of the invention. Further there are disclosed novel fastening materials and products produced by the apparatus and methods disclosed in the invention.

7 Claims, 8 Drawing Sheets

FASTENING MEANS, APPARATUS, AND METHODS

This is a divisional of co-pending application Ser. No. 07/118,120 filed on Nov. 4, 1987, now U.S. Pat. No. 4,861,399.

BACKGROUND OF THE INVENTION

This invention relates to fasteners of the type wherein two articles, or two parts of an article, are joined together, at least one of the joined articles or parts including an array of a plurality of fastening projections adapted to releasably inter-engage with the other article or part. In one aspect, the invention relates to such fasteners in which both components to be fastened include arrays of headed projections which can be simultaneously engaged with each other. In another aspect, the invention relates to an array of projections which may terminate in loops, or hooks, in the projections.

Typically, the array of projections is formed using a plurality of filaments which are joined with a backing material at spaced locations.

The art contains descriptions of fasteners including two articles, at least one of which includes an array of projections for providing fastener means. One such article comprises a woven fabric backing from which extend a plurality of headed projections adapted to join with loops of fiber projecting from another article, to effect the fastening. Such articles are produced by weaving two backing layers in parallel, closely spaced, relationship, with the filaments being woven therebetween. The filaments are then severed midway between the backing layers to form two brush-like halves, and the newly severed projecting filaments are heated to form heads on their terminal ends. These articles, however, are expensive to make because of the weaving required, and the woven backing does not hold the filaments as tightly as may be desired. Also, the fasteners cover essentially an entire surface of the substrate onto which they are fabricated.

Other of the art teaches embedding the projections of a longitudinally oriented polymeric filament material in a resinous polymeric bonding layer such that bight portions of the filament are physically embedded in the backing material. U.S. Pat. No. 4,290,174 Kalleberg is descriptive and illustrative of embedding the bight portions of the filaments into the backing material. Such embedding is also taught in U.S. Pat. No. 3,363,038 Billarant.

Illustrative of common methods of attaching filamentary material to a backing material is that shown in Kalleberg U.S. Pat. No. 4,290,174, wherein filaments are reciprocally pushed against the backing material at uniformly spaced intermittent locations, and wherein each locus of bonding a filament to the backing material requires a separate reciprocal pushing. Between each locus of bonding there is formed a loop in the material which becomes the structure from which the array of filament fasteners is eventually derived.

An alternate method of forming loops and subsequently providing for a backing material and bonding the loops to the backing material is disclosed in Billarant U.S. Pat. No. 3,363,038. The method of forming the loops is disclosed therein as comprising a complex arrangement of control members to push the filaments into grooves 94 in a forming wheel by means of bars 48 and counterbars 67. The filaments are then carried on bars 48 and counterbars 67 with subsequent extrusion of a polymeric backing material over the filaments to thereby bond a backing material to the filaments at the time that the backing material is formed into a sheet or film. Billarant teaches extensive camming apparatus, as well as a complex arrangement of filament feeding and forming apparatus which delivers the filaments to bars and counterbars in order to form the loops and hold their shape and position while the backing material is formed over the loops and subsequently solidified. Indeed counterbars 67 are retracted a distance from the filaments before extrusion of the backing material over the formed loops.

While there are a plurality of teachings in the art of methods for making the arrays of fasteners to which this invention relates, in each case the apparatus, or its method of use, is substantially complex, and in some cases requires large amounts of floor space and investment in equipment, as in the Billarant and Kalleberg patents.

It is an object of this invention to provide novel apparatus and improved methods for fabricating arrays of projecting fasteners. It is also an object of the invention to provide novel fastener combinations and novel articles of manufacture.

It is a specific object of the invention to provide a novel apparatus and novel methods of fabricating arrays of fasteners which function in a manner similar to arrays conventionally known.

SUMMARY OF THE INVENTION

One aspect of the invention is seen to be embodied in an apparatus for producing fastening components. The apparatus comprises means for drawing an array of filaments onto a forming wheel having a plurality of transversely arranged grooves, and land zones between the grooves, and means for positioning a plurality of pins against the filaments and aligned with the grooves. The apparatus includes means for urging the pins into the grooves, whereby the filaments are positioned between the surface of the wheel and the pins in the grooves, thereby forming loops in the filaments, the loops having tops thereof in the grooves. The filaments are in contact with the wheel at the land zones between the grooves. The apparatus further comprises means for placing a backing material against the filaments at the land zones and bonding the backing material to the filaments at the land zones while the filaments are in contact with the wheel, at the land zones between the grooves, to thereby form a bonded product from the filaments and the backing material. In so forming the bonded product, the pins are trapped in spaces between the filaments and the backing material. The apparatus comprises means for releasing the pins from the spaces. This may include means for cutting the loops at the tops to thereby form separate corresponding stem portions of the filaments extending from the backing material. The apparatus may, rather, comprise means for cutting the loops on their sides.

Another aspect of the invention is seen as an apparatus for processing filaments, including a nip for drawing filaments, and means for advancing the pins through the nip. The nip comprises a rotating forming wheel having two ends connected by a generally circular body portion, the wheel having a plurality of transversely arranged alternating grooves and land zones extending across the body between the ends. A backing means comprising a backing roll may be urged against the forming wheel and rotate cooperatively with the forming wheel. A plurality of pins are mounted for passing between the forming wheel and the backing roll, and are aligned with the grooves in the wheel as they pass through the nip, between the forming wheel and the backing roll. The pins are moveable through the nip in the direction of advance of the filaments through the nip, which corresponds with the direction of rotation of the forming wheel. The apparatus further includes means for advancing the pins through the nip, the pins being urged into the grooves during the advance through the nip, and whereby the filaments are positioned between the surface of the wheel and the pins in the grooves. Thus are loops formed in the filaments as the filaments are pushed into the grooves, the loops having tops in the grooves, and the filaments being in contact with the wheel at the land zones between the grooves. The pins may be released from the loops, after the filaments are bonded to the backing material, by cutting the loops at their tops to thereby release the pins and form corresponding stem portions of the filaments extending from the bights in the filaments where they are bonded to the backing material.

Preferably, the means for cutting the filaments comprises a heated roll. The heated roll may be rotating in a direction opposite the direction of advance of the filaments adjacent the heated roll.

The forming wheel preferably has a generally cylindrical outer surface which is undulating as it traverses the alternating grooves and land zones. A backing roll provides the means for urging the pins into the grooves as it is urged by urging means, such as a spring or pneumatic cylinder, against the forming wheel, the backing roll being capable of cooperative rotation with the forming wheel.

The backing roll and the pins provide means for urging first portions of an array of filaments into the grooves in the wheel to thereby form loops in the filaments. The backing roll urges second portions of the array of filaments against the corresponding land zones. Preferably, the backing material is urged against the second portions of the filaments at the land zones.

The apparatus includes means for applying sealing energy, which may include pressure, to thereby bond the second portions of the filaments to the backing material at the land zones.

In preferred embodiments, the pins are mounted on a pair of endless chains traveling along a path. The combination of the chains and the pins defines a carrier, the carrier being adapted for carrying the bonded product along the path by means of the pins.

The apparatus further includes a cutting mechanism comprising a rotatable cutting wheel having a plurality of cutters on an outer, generally cylindrical surface thereof. The cutting wheel is disposed and adapted for rotating the cutters into the path, and along the direction of advance of the carrier, and for urging the cutters against corresponding ones of the pins. The filaments are thereby cut, thus effecting the releasing of the pins from the spaces. The pins may have channels extending along their lengths and disposed toward the cutting wheel, and adapted to receive portions of the filaments during the cutting of the filaments.

The novel nip described herein, and comprising the rotating forming wheel, the backing roll, and the plurality of pins, may be used for drawing material, such as sheet material through the nip, as well as for drawing filamentary material.

The nip may include two sprockets adjacent the two ends of the forming wheel, the sprockets having grooves therein. The sprockets are rotatable with the forming wheel, and the grooves on the sprockets are aligned with the grooves on the forming wheel. The nip apparatus further comprises a pair of chains on the sprockets, with each of the pins being attached to both of the chains, such that each pin is positioned in one of the grooves in the forming wheel and extends between corresponding aligned grooves on the sprockets as the pins advance through the nip. Thus the forming wheel and the sprockets rotate together and thereby advance the pins and the filaments, or other material to be formed, at a common rate and in a common direction.

Another way of describing the invention is as apparatus for bonding loops of filaments to a backing material at spaced locations on that backing material. In this case the apparatus may be described as comprising rotating positioning means for presenting nonretractable land zones to a bonding station. It further includes a rotatable backing roll and means for urging the backing roll against the rotating positioning means, and means for forming loops in filaments, wherein the loops comprise first portions of the filaments spaced from the land zones and second portions of the filaments disposed on the land zones. The apparatus further comprises means for placing a backing material against second portions of the filaments at the land zones, and urging the backing material against those second portions and corresponding ones of the land zones, and applying sealing energy to the combination of the backing material and the filaments at the nonretractable land zones. In some cases the backing roll and the means for forming the loops in the filaments are juxtaposed at a first location against the positioning means, and the means for applying sealing energy and pressure is juxtaposed against the positioning means at a second location on the positioning means.

In any of the apparatus of the invention, the land zones may be intermittently spaced about the forming wheel.

In the method of the invention, and namely that for producing fastening components, an array of filaments is drawn onto the forming wheel. A plurality of pins is positioned over the filaments and aligned with the grooves. The pins are urged into the grooves, preferably by the backing wheel, and backing material is placed against the filaments and bonded to them while the filaments are in contact with the wheel between the grooves. Thus the pins are trapped in spaces between the filaments and the backing material. The releasing of the pins preferably includes cutting of the filaments. The loops are preferably cut at their tops to thereby release the pins and form corresponding stem portions of the filaments extending from the backing material. The loops are preferably cut by means of melting portions of the loops with the heated roll, which may leave irregular terminal ends on the cut filaments. Regular terminal ends may then be formed by passing the irregular ends past a heated platen.

It is preferred that, before the cutting of the loops, a sufficient amount of heat be conveyed to the filaments to attenuate bending stresses imposed on the loops at the time the loops are formed against the forming wheel, thereby fixing the direction of projection of the filaments in a direction generally away from the backing material. It is preferred to provide sufficient heat such that the direction of projection of the filaments from the backing material is at an angle of at least 30 degrees from the backing material.

The invention also includes a novel fastening material combination. The combination includes a backing material and a plurality of flexible, generally U-shaped filaments. The backing material comprises a thermoplastic surface layer which forms an outer surface of the backing material. Each of the generally U-shaped filaments includes a central bight portion bonded to the thermoplastic surface layer and covering a portion of the outer surface of the backing material, and two stem portions extending from opposite ends of the bight portion and projecting in a direction generally away from the thermoplastic surface layer, with at least one of the stem portions having a terminal fastening member. The terminal fastening member may comprise, for example, a hook or a mushroom-shaped head.

In some embodiments, the U-shaped filaments are intermittently spaced on the backing material. This intermittent spacing corresponds, in general, to intermittent spacing of the land zones, and corresponding wide grooves, on the forming wheel.

DETAILED DESCRIPTION OF THE ILLUSTRATED EMBODIMENTS

Figure 1:
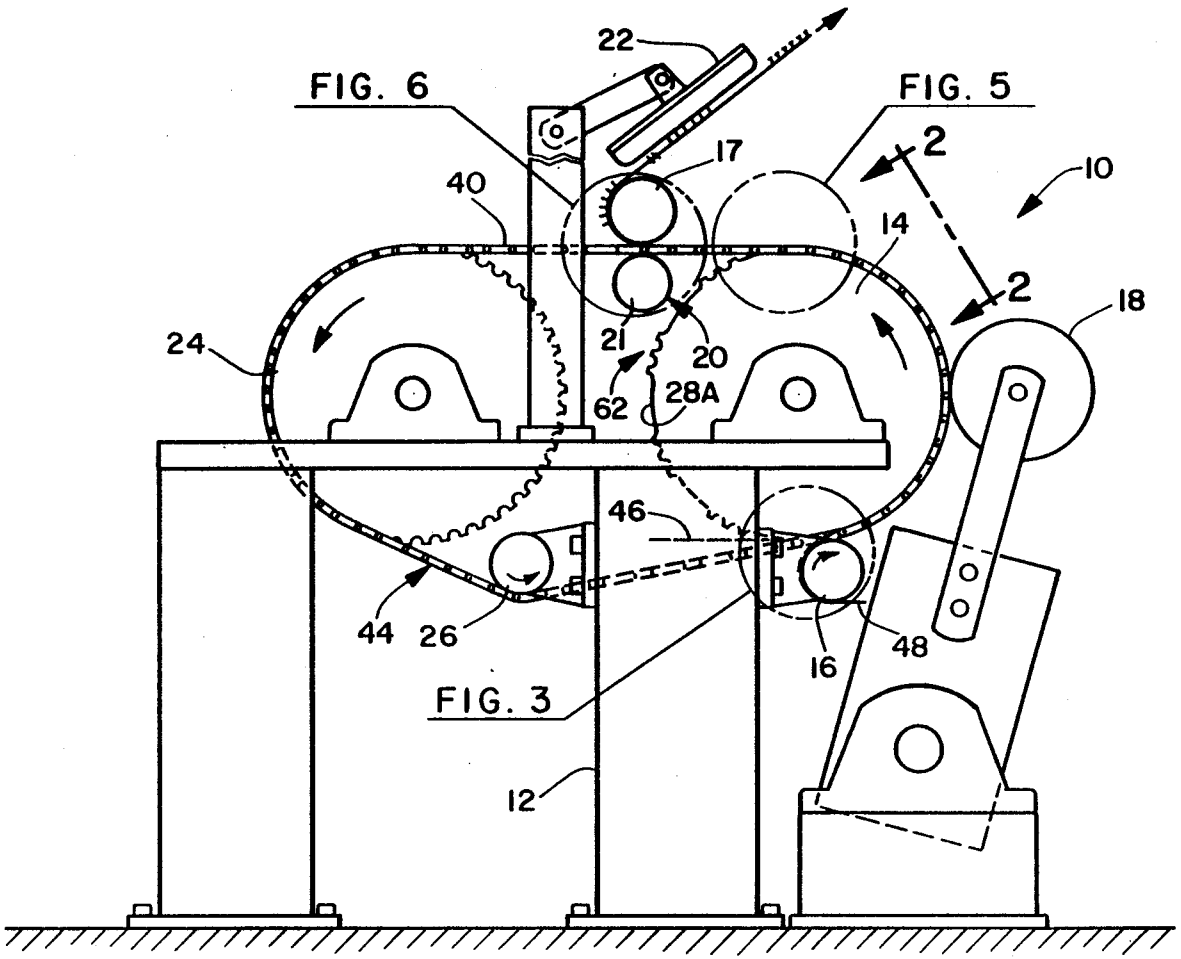
FIG. 1 shows a side view of apparatus of the invention with intermittent spacing of the grooves and land zones.

Referring now to FIG. 1, the apparatus of the invention which is useful for forming fastening components of the invention is generally depicted as 10. The apparatus is generally supported by a frame 12. The frame supports a driven forming wheel 14, a backing roll 16, a bonding mechanism 18, a cutting station 20, a heated platen 22, turning gear 24, and tensioning roll 26.

Figure 2:
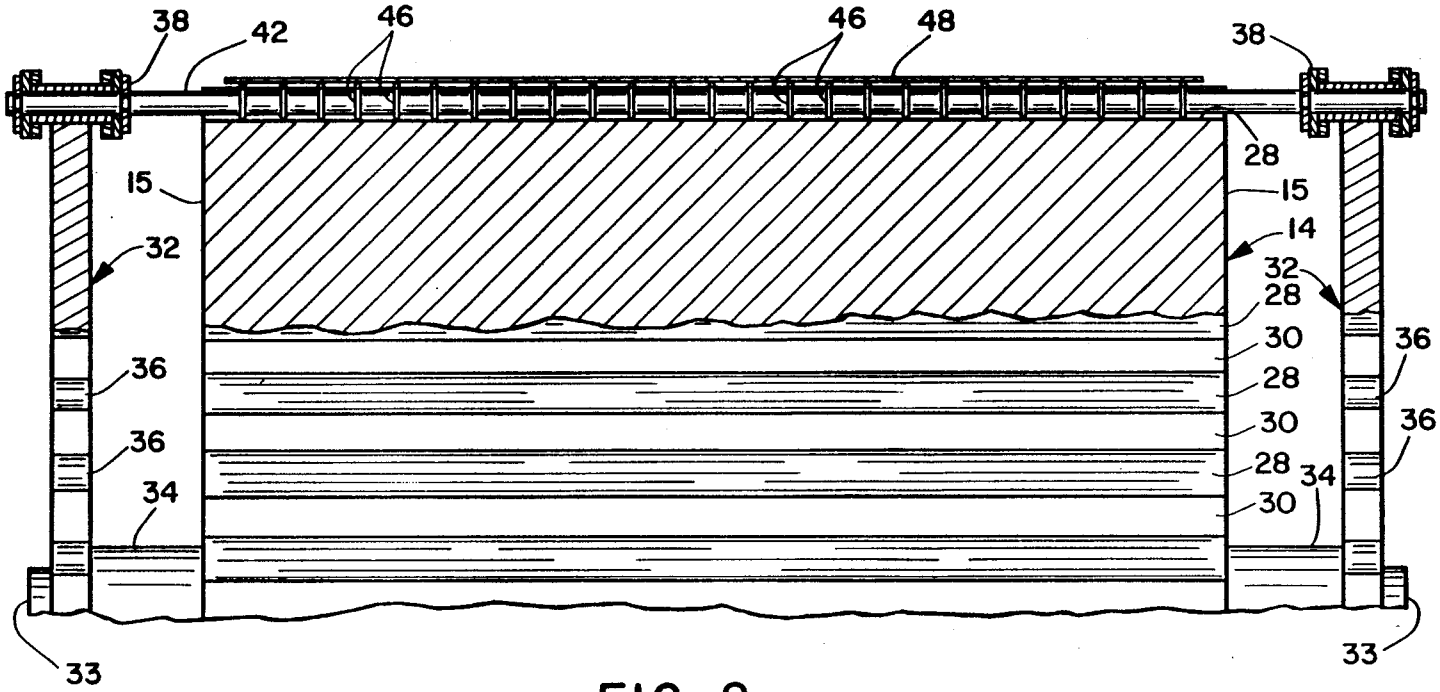
FIG. 2 shows a partial front elevation view, partially in section, of the forming wheel and sprocket subassembly, including the chains and pins, as indicated at 2—2 in FIG. 1, but with grooves and land zones uniformly spaced.

Forming wheel 14 has two ends 15 connected by a generally circular body, and a plurality of grooves 28 and land zones 30 extending transversely across the generally cylindrical surface of the body. A pair of sprockets 32 are rigidly mounted to a common shaft 33 to which forming wheel 14 is also mounted. Thus sprockets 32 rotate with forming wheel 14 by means of the common shaft. Spacers 34 separate sprockets 32 from the ends 15 of forming wheel 14. Sprockets 32 have grooves 36 corresponding to grooves 28 in forming wheel 14. Grooves 36 are smaller in cross-section than grooves 28, for reasons explained hereinafter. Grooves 36 on sprockets 32 are aligned with grooves 28 on forming wheel 14. A pair of endless chains 38 is carried on sprockets 32, as seen in FIG. 2, and circumscribes an endless path 40 about forming wheel 14, bonding mechanism 18, cutting station 20, turning gear 24, and tensioning roll 26. A plurality of pins 42 extends between corresponding links of the two chains 38, and extends transversely across path 40, such that the combination of chains 38 and pins 42 defines a carrier 44 traveling along path 40.

Figure 3:
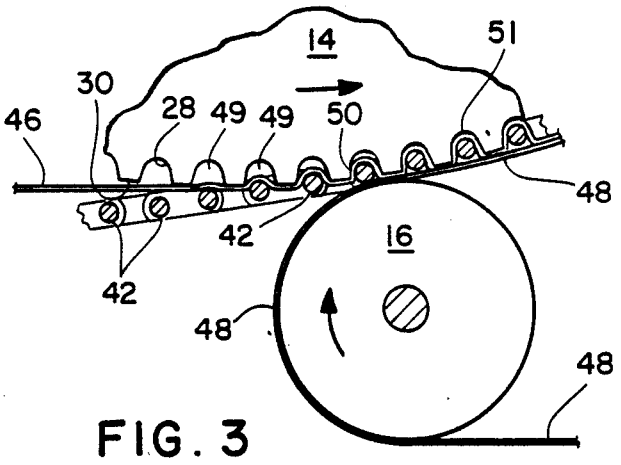
FIG. 3 shows an enlarged view of the infeed section of the forming wheel as indicated by the encircled area at "FIG. 3" in FIG. 1, and showing the grooves and land zones uniformly spaced.

As forming wheel 14 is driven by drive means, not shown, in the direction indicated by the arrows, an array of filaments 46 is drawn into the nip formed by the combination of the forming wheel 14, the backing roll 16, and the pins 42. The nip itself is comprised of (i) the compression between the backing roll 16 and land zones 30, and (ii) the friction in spaces 49 between pins 42 and grooves 28 as the pins are urged into the grooves by backing roll 16. FIG. 3 has two of the spaces numbered as 49, one of which spaces is being formed as the pin 42 is being pushed into the groove 28, and the other of which is essentially fully formed.

Simultaneously, backing material 48 is drawn into the nip as shown in FIGS. 1 and 3. Typically the filaments 46 are equally spaced from each other and are drawn into the nip parallel to each other. As seen in FIG. 3, backing roll 16 is urged against forming wheel 14, such that the pins 42 are forced into grooves 28 by the backing roll 16. As a pin 42 is urged into the corresponding groove 28 with which it is aligned, it carries portions of filaments 46 into the groove and forms a loop 50 in each of the filaments. Loops 50 are positioned in the groove 28 in space 49 between the surface of the groove and the surface of the corresponding pin 42.

Forming wheel 14 could be eccentric, provided backing roll 16 and bonding mechanism 18 are correspondingly eccentric or are resiliently mounted such that they can track the eccentricity of the forming wheel.

Carrier 44, comprising pins 42 and chains 38 is moved about path 40 by the driving force applied by forming wheel 14, primarily at the nip with backing roll 16. As a pin 42 is urged into a corresponding groove 28 in forming wheel 14 by the pressure of backing roll 16 against forming wheel 14 and the pin 42, the driven rotation of forming wheel 14 urges the surface of the corresponding groove 28 against the filaments 46, and through them, the pin, to move the pin 42 in the direction of rotation of forming wheel 14. As the pin is moved in the direction of rotation of forming wheel 14, it causes the advance of endless carrier 44 along endless path 40. While pins 42 are caused to move by the action of grooves 28 in urging them along the path of rotation of forming wheel 14, filaments 46 are generally drawn into the nip by the pressure between backing roll 16 and forming wheel 14.

Typically, grooves 28 are somewhat larger than pins 42, such that filaments 46 are more or less loosely held in spaces 49 in grooves 28. Thus, grooves 28 are, in general, not responsible for the drawing of filaments 46 into the nip.

The grooves, pins, and filaments may, alternatively, be so sized as to constrict filaments 46 in the grooves 28 such that constriction between the grooves and the pins does draw the filaments into the nip. Preferably, filaments 46 are loosely fitted into grooves 28 by pins 42. In that regard, the primary force for the drawing of filaments 46 into the nip is typically provided by pressure between backing roll 16 and land zones 30.

It is seen that the pressure of backing roll 16 against forming wheel 14 forms two nips which draw both the backing material 48, and the filaments 46, and place the backing material against a first portion of the filaments at the land zones 30, as well as positioning the pins and second portions of the filaments in grooves 28, thereby forming the loops 50 in the filaments.

The first nip draws the filaments 46 and comprises (i) the compression between the backing roll 16 and land zones 30 and (ii) the contact between grooves 28 and pins 42, as the grooves and pins hold the filaments between them. The first nip draws the filaments 46. The second nip comprises the compression between backing roll 16 and land zones 30, and draws backing material 48. Thus the first and second nips have in common the compression between backing roll 16 and land zones 30, with the first nip additionally comprising grooves 28 and pins 42, in combination.

Tensioning roll 26 is used to adjust the tension on the chains 38. With a modest tension applied to chains 38, pins 42 are firmly held in grooves 28 as they advance along the portion of the path defined by forming wheel 14.

Figure 4:
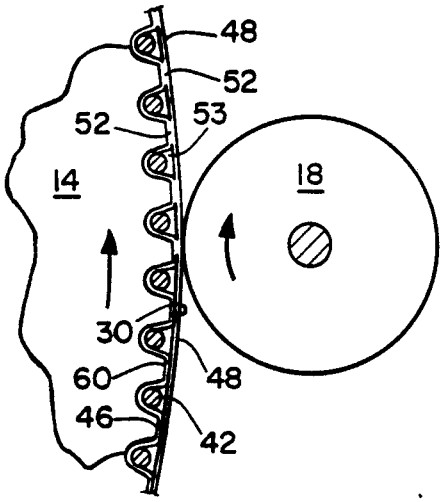
FIG. 4 is an enlarged side view of the bonding station showing the detail of the bonding operation, again showing the grooves and land zones uniformly spaced.

As the combination of the surface of forming wheel 14, the pins 42, filaments 46, and backing material 48 passes through the nip formed by forming wheel 14 and bonding mechanism 18, bonding energy is applied to backing material 48 such that filaments 46 are bonded to backing material 48 at land zones 30 as seen in FIG. 4. The bonding is shown in FIG. 4 as bonds 52 wherein the filaments are bonded to the backing material at bight portions 60, described in more detail hereinafter. Bight portions 60 cover a portion of the surface of the backing material, generally corresponding to the projected diameter of the filament along the length of which it contacts the backing material.

Figure 5:
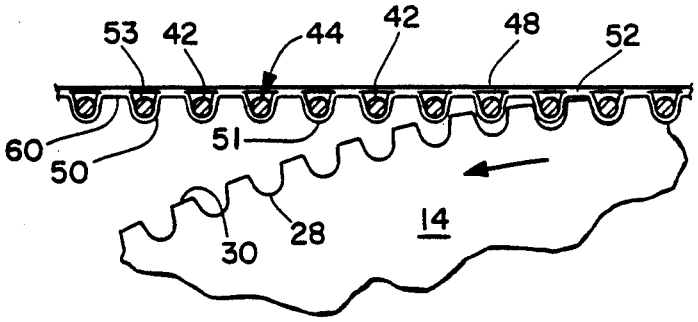
FIG. 5 shows an enlarged view of the exit section of the forming wheel as encircled at "FIG. 5" in FIG. 1, and showing the grooves and land zones uniformly spaced.

In the preferred embodiments, the process of bonding the filaments to the backing material conveys to the filaments a sufficient amount of heat to attenuate bending stresses in the filament loops 50. Thus the direction of projection of the filaments 46 from the backing material 48 is fixed generally in the direction of projection of the filaments from the backing material. In this respect, when the filaments are later cut at cutting station 20, the filaments continue to project from the backing material at an angle of at least 30 degrees from the backing material, preferably at least 60 degrees, and most preferably at least 75 degrees A preferred bonding mechanism 18 is an ultrasonic bonding unit. A highly satisfactory unit is a rotary ultrasonic welder available from Mecasonics Company located in Lyon, France. After the backing material and filaments are bonded to each other by bonding mechanism 18, the bonded product progresses along the path of the forming wheel and leaves the forming wheel 14 at the top of the wheel in the area shown in the circle 5 in FIG. 1 and seen in enlarged illustration in FIG. 5. As seen in FIG. 5, the carrier 44 carries the combined filaments and backing material away from forming wheel 14 and toward cutting station 20. FIG. 5 shows only pins 42 of carrier 44, the chains 38 having been omitted for the sake of clarity. It will be understood, though, that chains 38 connect pins 42 as indicated in FIGS. 2 and 3. It is seen, particularly in FIG. 5, that pins 42 are trapped in spaces 53 between filaments 46 and backing material 48.

Figure 6:
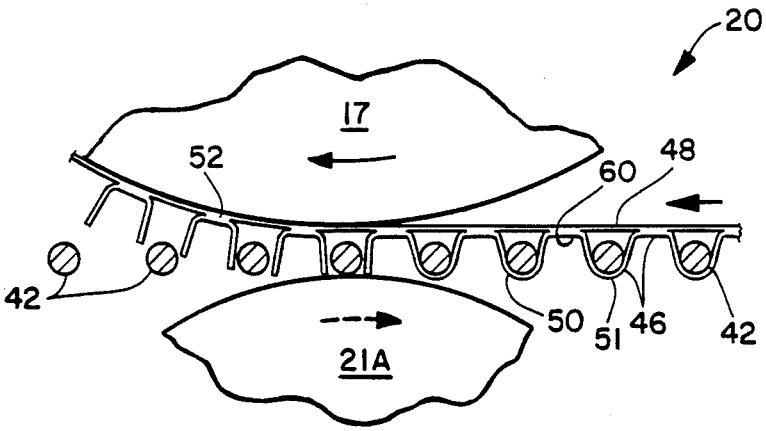
FIG. 6 shows an enlarged view of the cutting section as encircled at "FIG. 6" in FIG. 1.
Figure 7:
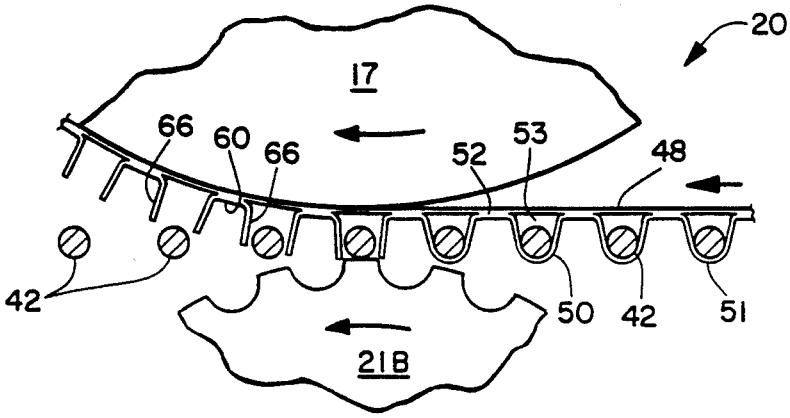
FIG. 7 shows an enlarged view of an alternate cutting apparatus.

Pins 42 are released from those spaces 53 by the cutting of filaments 46 at cutting station 20. Cutting station 20 generally comprises a cutter 21, and positioning roll 17 for positioning the bonded product relative to cutter 21. Letter suffixes, such as "A" in FIG. 6, are used to illustrate alternative cutters. The cutting station 20 may be simple, such as a stationary heated roll as cutter 21A, seen in FIG. 6. As the bonded material passes the heated roll, the heat from the roll causes the melting of the tops 51 of loops 50 such that the loops are opened and pins 42 are released. The dashed arrow on cutter 21A in FIG. 6 shows that cutter 21A may, optionally, be rotated, as in a direction opposite the direction of advance of the bonding material adjacent the heated roll cutter 21A. FIG. 7 shows a cutter 21B having land zones which advance in register with the approach of uniformly spaced loops 50 and pins 42 such that the heat on the land zones cuts the loops 50, releasing the pins 42 from the loops 50. It is seen that cutter 21B rotates in the same direction as the direction of advance of the bonded material adjacent cutter 21B.

Figure 8:
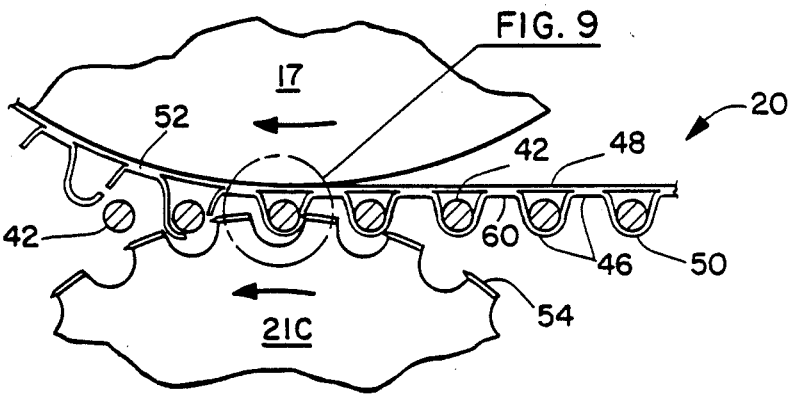
FIG. 8 shows an enlarged cutting apparatus for cutting the loops on the sides.
Figure 9:
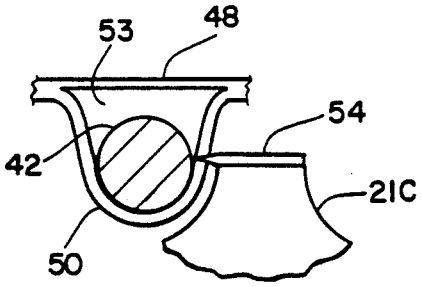
FIG. 9 shows yet another enlarged view of the cutter in operation as depicted at "FIG. 9" in FIG. 8.

FIGS. 8 and 9 show a cutter 21C having cutting blades 54 which advance against the sides of pins 42, thus forming loops in the cut filaments for the formation of loop shaped fasteners.

Figure 10:
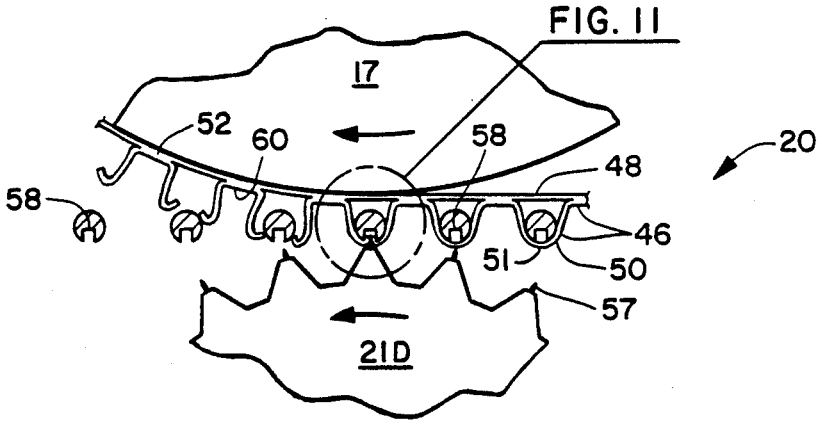
FIG. 10 shows an enlarged view of yet another cutting apparatus.
Figure 11:
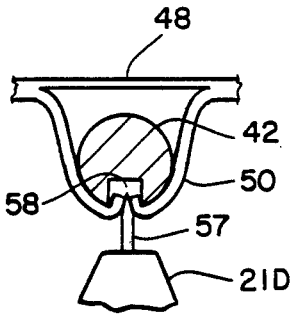
FIG. 11 shows a further enlargement of the encircled area at "FIG. 11" in FIG. 10.

FIGS. 10 and 11 illustrate a cutter 21D having cutting blades 57 which cut the loops 50 at the tops 51 thereof in cooperation with modified pins 42 having channels 58 which receive blades 57 and filaments 46 in cooperation with the cutting of filaments 46 as seen in FIG. 11.

In some cases, the cutters illustrated herein operate solely by the application of heat to the filaments 46 to effect the cutting of the filaments and release of the pins. Others of the cutters, for example in FIGS. 8 and 10, use cutters which appear to function more by severing than by melting. It is highly satisfactory, in some embodiments of the invention, that the cutters which function by an apparent severing mechanism may also apply heat to the filaments to employ the cutting combination of severing as by a sharp edge together with at least some melting by the application of heat. Also tension may be applied to the filaments to assist in effecting the cutting. Tension can be applied, for example, by boots, not shown, adjacent each blade 57 on cutter 21D in FIG. 11.

After pins 42 have been released from the spaces 53 between filaments 46 and backing material 48, the pins progress with carrier 44 about the remainder of the endless path 40, and particularly about turning gear 24 and tensioning roll 26; and thereby return to the nip for continuation of the process.

Figure 12:
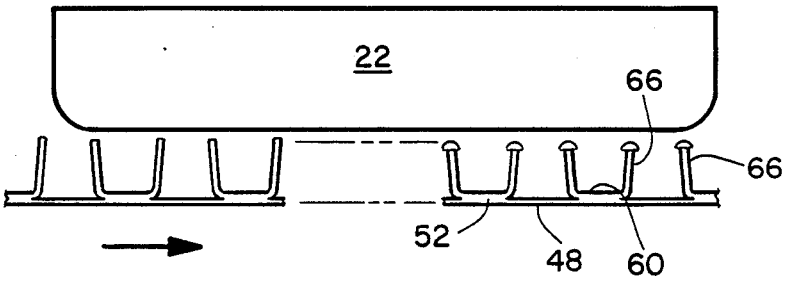
FIG. 12 shows a side view of the heating platen forming the mushroom retainer heads.

In certain embodiments, the cutting leaves irregular terminal ends on the cut filament portions, as seen in FIGS. 6 and 12. In especially the embodiments illustrated, for example, in FIGS. 6 and 7, the fabrication of the fastening components preferably includes the formation of mushroom-shaped heads on the cut filaments. To that end, the bonded product is passed adjacent a heated platen 22. The heat from the platen 22 melts the ends of the cut filaments, making regular terminal ends in the form of conventionally-recognized mushroom-shaped heads in a conventional heating process as seen in FIG. 12.

In FIG. 1, the cutting station 20 and the heating station at platen 22 are separated. Optionally, an accumulator is provided between cutting station 21 and platen 22. The accumulator may be, for example, a winder. In that case the product is separately unwound and passed adjacent platen 22 using a separate sheet drive means independent of the drive means which controls the speed of the forming and bonding operation. Thus, the linear speed of the material past platen 22 may be varied independently of the speed of forming wheel 14 to the formation of the regular terminal ends. Generally, a slower speed at platen 22 produces more pronounced heads.

Figure 1A:
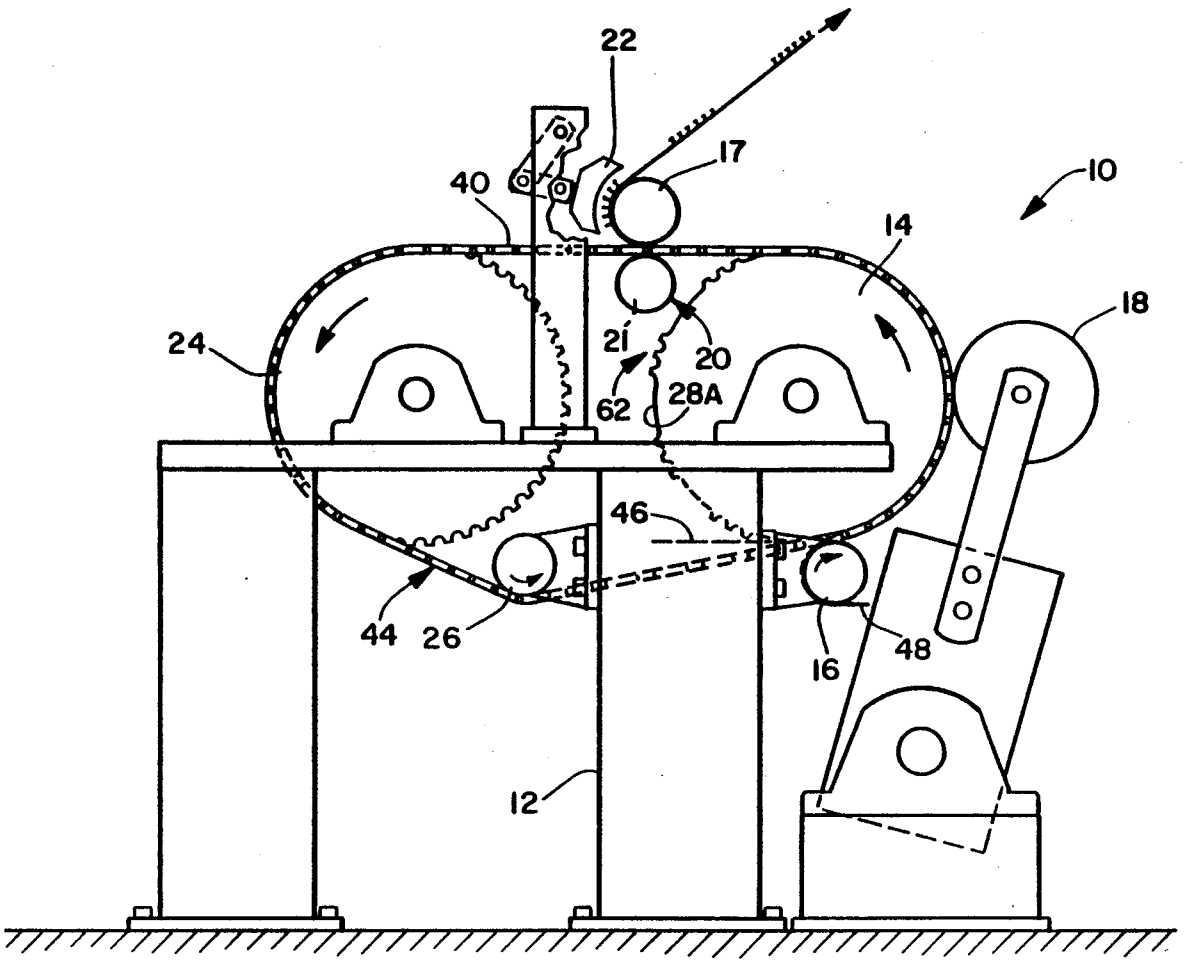
FIG. 1A shows a side view of a second embodiment of the invention.

FIG. 1A shows the cutting station 20 and platen 22 combined to perform the cutting and head forming operation at one location and time.

In processes where the loops are cut along their sides, as in FIGS. 8 and 9, to form hooks, the fabrication of the fastening components is completed upon the cutting of the filaments and the removal of the pins 42; and platen 22 is typically omitted, moved away from the filaments, or not heated. Hook shaped fastening components are also formed by the process seen in FIGS. 10 and 11, especially when the cutting process is accompanied by the application of heat as at blades 54.

It is clear from the description of the bonding operation as seen in FIG. 4 that the backing material is bonded to the filaments at spaced locations while the filaments are in contact with the forming wheel at the land zones between the grooves. Clearly there is direct pressure between the land zones, which land zones aid in the formation of the bonds, and the bonding mechanism 18, during the formation of the bonds. It is seen that, in the preferred embodiments of the invention, the land zones 30 are nonretractable, and, indeed, need not be retractable, but could be, with respect to the forming wheel; as they form an integral part of the forming wheel.

Figure 13:
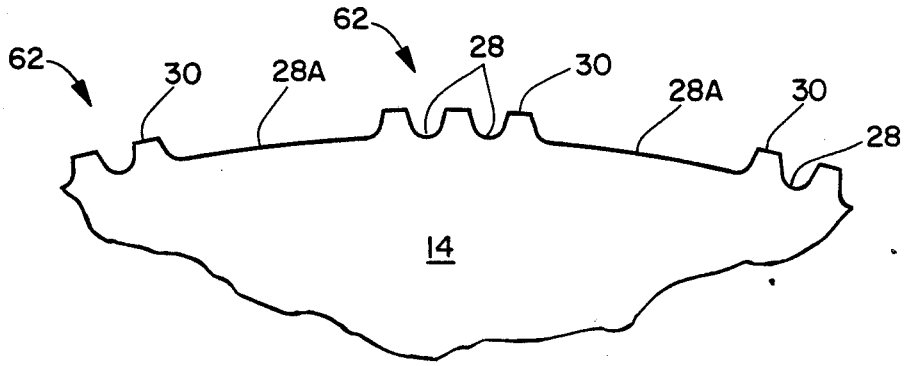
FIG. 13 shows a portion of a forming wheel having uniformly spaced land zones and grooves.
Figure 14:
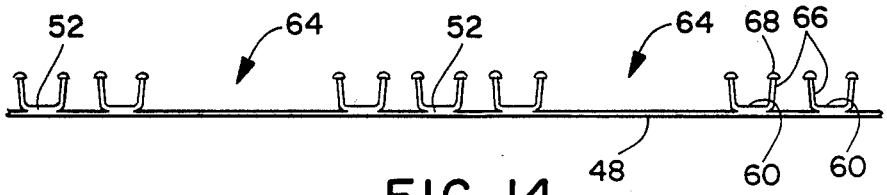
FIG. 14 illustrates the bonded product of the invention having the fasteners grouped intermittently along an elongated section of the backing material.

In some cases it is desirable to form the fastening components in intermittently spaced groups along the length of backing material 48, as seen in FIGS. 1 and 13. In those cases, groups 62 of land zones 30 are intermittently spaced about forming wheel 14 as seen in FIG. 1; with interruptions between the groups. A forming wheel 14 having intermittently spaced land zones as in FIG. 1 has corresponding grooves 28 and extended grooves 28A between the groups 62 of land zones 30. The finished bonded product formed using the forming wheel having the groups 62 of intermittently spaced land zones is illustrated in FIG. 14, wherein the fasteners are grouped together with spaces 64 between the groups of fasteners. Spaces 64 are derived from corresponding extended grooves 28A during the process of fabricating the finished bonded products.

Figure 15:
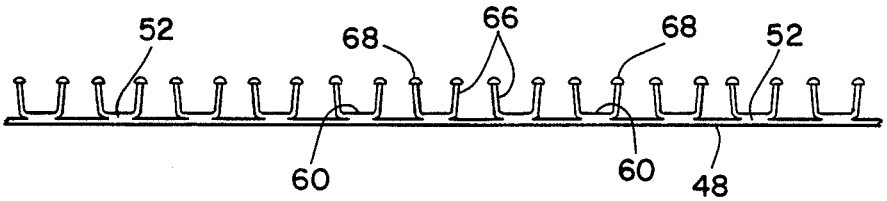
FIG. 15 illustrates the bonded products of the invention wherein the fasteners are regularly spaced along an elongated section of the backing material.

In other embodiments of the invention, illustrated in FIGS. 2–11, the grooves and land zones are more or less uniformly spaced about the forming wheel. The finished bonded product formed using the forming wheel having the uniformly spaced land zones is illustrated in FIG. 15.

Filaments 46 may be comprised of any thermoplastic material which can be firmly bonded to backing material 48. Backing material 48 is a sheet material which can be bonded to filaments 46. Sheet material 48 may be, for example, a spun bonded thermoplastic. It may be a solid sheet such as a plastic film. It may be a laminated sheet having a thermoplastic surface. So long as backing material 48 and filaments 46 can be successfully bonded to each other, the selection of materials is otherwise not critical to the process, so long as the filaments 46 can accept and hold a shape for the fastener elements. Each fastener element, in the finished product, as illustrated, includes a bight portion 60 aligned with, and bonded to, backing material 48, and a stem portion 66 projecting from the bight portion 60 at backing material 48, as seen for example in FIGS. 7 and 12. Highly satisfactory material for filaments 46 is polypropylene. Backing material 48 may also be polypropylene, either a spun bonded sheet, or a solid film. With respect to a spun bonded polypropylene, the backing material may be as light as, for example, 2 oz/yd$^2$. Similarly, acceptable backing film is comprised of a polypropylene film 10 mils (0.01 inches) thick. Illustrative of a multiple layer backing material is a spun bonded polypropylene at 2 oz/yd$^2$ with one mil of polypropylene film on either side of it. Typical of polypropylene filaments which can be bonded to the illustrated backing materials are filaments having diameters ranging between 6 and 12 mils. When polypropylene is used for the composition of filaments 46, a heated cutter 21 illustrated as 21A or 21B may be operated at a temperature of about 325°–330° C. Similarly, platen 22 is operated at a temperature of about 340°–345° C. to form the illustrated mushroom heads 68.

The material compositions of filaments 46 and backing material 48 may be freely selected so long as they are compatible with being bonded to each other. The filaments must, of course, be capable of forming the loops 50; and the backing material 48 must be capable of circumscribing the arcuate path of a forming wheel, as 14.

Returning now to the combination of FIGS. 1, 3, and 4, it is seen that the filaments 46 and backing material 48 to be bonded together pass through nips at backing roll 16 and bonding mechanism 18. By the time the material has passed through bonding mechanism 18, the bonds 52 have been formed between the backing material 48 and the filaments 46. The nips at bonding mechanism 18 and backing roll 16 provide firm control of the rate of advance of both the backing material and the filaments. The process, then, is fairly insensitive to infeed tension of either the filaments or the backing material, so long as that tension is not so great as to cause undesirable rupture of the material being drawn. Critical to this insensitivity is the pressure urging the filaments 46 and the backing material 48 against each other during the formation of the bonds between bights 60 and the backing material 48 at bonding mechanism 18. Thus any tendency of the backing material or the filaments to withdraw from each other during the bonding process is attenuated by the nip forces urging them together during the bonding process.

Figure 16:
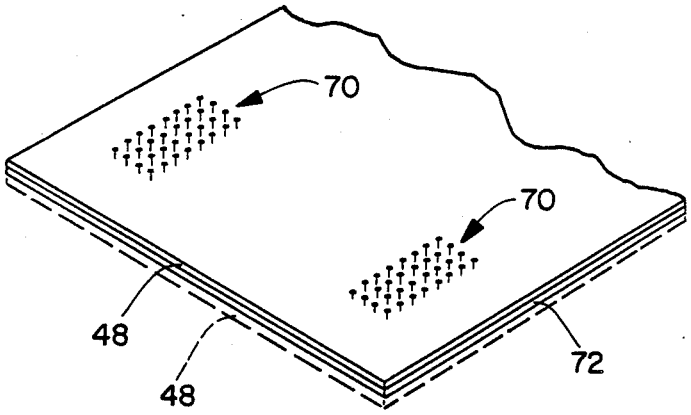
FIGS. 16 and 17 show typical articles of manufacture of the invention.
Figure 17:
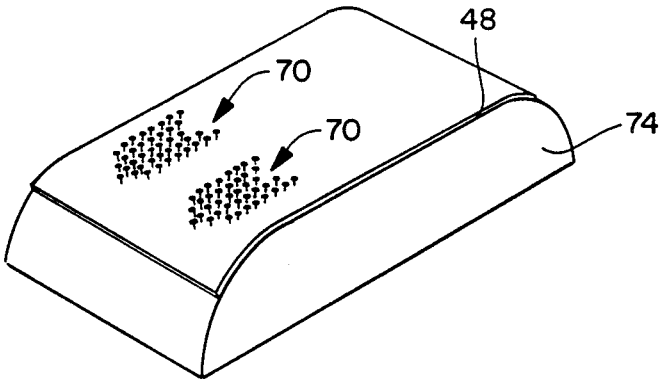

As seen in FIG. 14, the apparatus and processes of the invention may be used to create spaced groupings of fasteners on the backing material 48, with the free space 64 being free of fasteners. By proper spacing of grooves 28 and land zones 30 on forming wheel 14, arrays 70 of fasteners may be placed at intermittent locations on the backing material 48 as seen in FIGS. 16 and 17. FIG. 16 shows the flexible bonded product, including arrays 70 and backing material 48 attached to a second flexible layer 72. FIG. 17 shows the flexible product attached to nonflexible second layer 72 which is represented as a thick section molded product, such as an arm rest.

Thus the invention may be used in fabrication of flexible sheets as at FIG. 16. It may also be used to provide the fastening properties of the fasteners of the invention to a less flexible, or rigid, product.

It is seen in the embodiments illustrated in FIGS. 16 and 17 that less than the entire substrate can be covered with the fasteners. It is preferred that the fasteners be formed in groups, or arrays 70, which cover only a fraction of the surface of the backing material. The area between the arrays is then free from the fasteners.

In those embodiments where the fasteners are in arrays 70, the arrays usually cover less than 75% of the surface area, leaving at least 25% free from fasteners. Preferably at least 50%, highly preferably at least 75%, most preferably at least 90% of the surface area of the backing material is free from the fasteners.

In the embodiments used to form multiple layer products, whether flexible or non-flexible, the layer in general contact with the backing material layer 48 is usually mutually coextensive with the backing material over at least 75%, preferably at least 90%, of the surface area of both layers, in the finished product. The backing material thus can be used as a structural (strength contributing) component of the article of manufacture.

In certain embodiments of the invention represented in FIG. 16, the second layer 72 is absorbent of liquids. For example, layer 72 may be comprised of water absorbent pulp, fiber, or natural or modified celluloses, or certain of the well known super absorbent materials which swell and form a gel upon absorption of water.

To the extent layer 72, or other outer layer on that same side of backing material 48, is fibrous, headed or hooked fasteners in arrays 70 are functional for interengaging with the fibers in the outer layer. Thus the multiple layer material may be lap folded onto itself such that the arrays 70 engage lapped-over portions of the fibrous opposite side, and engage with that opposite side to functionally fasten portions of the sheet material to itself.

Within the context of the multiple layer sheet material being used as an absorbent product, backing material 48 preferably serves as a moisture barrier, and so is made from a moisture barrier polymer such as one of the olefins, preferably a propylene polymer or an ethylene polymer.

In another embodiment, shown in phantom in FIG. 16, the sheet material may comprise two outer layers, each fabricated from a backing material 48 having the recited arrays 70 formed on it. The backing materials may be the same, or different. Intermediate layers may be interposed between the two outer layers of backing materials to provide any of a number of functionally desirable properties. Where at least one of the backing layers is moisture permeable, the intermediate layer (layer 72 in the 3 layer embodiment of FIG. 16) may be especially adapted to absorb moisture in a conventional absorbent article. In other embodiments it may serve a cushioning function. In other cases it may provide tensile strength, or toughness, shock resistance, opacity, barrier to gaseous permeation, and the like. Indeed, layer 72 may represent a single or multiple layer substructure having a plurality of desirable functional properties.

Thus it is seen that the invention provides novel methods and apparatus for fabricating arrays of projecting fastening means, fastening components, and the like. It provides for methods of fabricating fastening materials of the hook or mushroom-head type without the usual reciprocating motion.

The invention further provides such novel methods and apparatus which are adapted for fabricating arrays of fasteners which function in a manner similar to the functioning of conventionally known arrays.

The invention further provides novel combinations of fasteners projecting from backing material, where bight portions of the fastener filaments cover portions of the surface of the backing material.

As can be seen from the instant disclosure, substantial modification to the apparatus, and, in some cases, modification to the methods may be practiced without departing from the spirit of the invention. Thus the invention is not intended to be limited to the embodiments disclosed herein, but rather, should be interpreted according to the appended claims.

Having thus described the invention, what is claimed is:

1. A fastening material, comprising;

(a) a backing material comprising a thermoplastic surface layer, said thermoplastic surface layer forming an outer surface of said backing material; and (b) an array of flexible, generally U-shaped filament segments, each said filament segment including a bight portion bonded to said thermoplastic surface layer and covering a portion of said outer surface of said backing material, and two stem portions extending from opposite ends of said bight portion and projecting in a direction generally away from said thermoplastic surface layer, at least one of said stem portions having a terminal fastening member, (c) said u-shapes in said filament segments being formed by pins urging first portions of said filament segments into grooves on a forming wheel, said bight portions corresponding to second portions of said filament segments, said second portions being between corresponding first portions of said filament segments, the configuration of said bight portions being formed from said filament segments by land zones on said forming wheel between said grooves, said bight portions being bonded to said outer surface of said backing material in formation of said bight portions, (d) said U-shaped filament segments being intermittently spaced, and corresponding to intermittent spacing of said land zones, and corresponding extending ones of said grooves, on said forming wheel.

2. The material of claim 1 wherein said backing material has at least 25 percent of said surface area free from said array of filament segments.

3. The material of claim 1 further comprising a second layer of material being attached to said backing material.

4. The material of claim 3 wherein both said second layer material and said backing material are made of a flexible material.

5. The material of claim 3 wherein said second layer material is a nonflexible material.

6. The material of claim 3 wherein said second layer material is an absorbent material.

7. The material of claim 1 wherein said backing material is a nonflexible material.

* * * * *